United States Patent [19]

Nijman

[11] 4,175,320

[45] Nov. 27, 1979

[54] CONDUCTOR TERMINATING APPARATUS

[75] Inventor: John P. Nijman, West Hill, Canada

[73] Assignee: Bunker Ramo Corporation, Oak Brook, Ill.

[21] Appl. No.: 831,470

[22] Filed: Sep. 8, 1977

Related U.S. Application Data

[63] Continuation-in-part of Ser. No. 772,222, Feb. 25, 1977, abandoned.

[51] Int. Cl.[2] ..... H01R 43/04

[52] U.S. Cl. ..... 29/749; 29/751

[58] Field of Search ..... 29/749, 751, 753, 759, 29/760, 566.3, 566.4

[56] References Cited

U.S. PATENT DOCUMENTS

| | | | |
|---|---|---|---|
| 4,035,897 | 7/1977 | Over et al. | 29/749 X |
| 4,047,294 | 9/1977 | Quigley | 29/749 |
| 4,048,710 | 9/1977 | Nijman | 29/566.4 |

*Primary Examiner*—Carl E. Hall

*Attorney, Agent, or Firm*—William Lohff; F. M. Arbuckle

[57] ABSTRACT

An apparatus is disclosed for simultaneously terminating a plurality of insulated metallic conductors in the insulation-piercing contact members of a multi-contact connector. The apparatus includes a base which supports the connector in conductor-receiving position and a carriage which carries a reciprocating insertion tool. The carriage is pivotally attached to the base and moves between an open position and an operating position wherein the insertion tool is aligned with the connector. Locating means are mounted on the carriage in fixed spatial relation to the insertion tool to align the connector for the termination operation as the carriage moves to the operating position. Self-locking latch means retains the carriage in the operating position and includes a release means which may be actuated while returning the carriage to the open position, all in a single operation.

14 Claims, 6 Drawing Figures

CONDUCTOR TERMINATING APPARATUS

This is a continuation-in-part of application Ser. No. 772,222, filed Feb. 25, 1977, now abandoned.

BACKGROUND OF THE INVENTION

The present invention relates to apparatus for use in terminating conductors and electrical connectors and, more particularly, to a device which facilitates the in-the-field connection of insulated conductors with multiple contact electrical connectors.

With the advent of miniaturized electronics and electrical components, connectors used in the electrical, communication and data handling industries have been reduced in size, making it more difficult to connect the small, insulated conductors with the appropriate contact terminals of the connector. Accordingly, a wide variety of tools and mechanical devices have been developed in recent years directed at simplifying and expediting the assembly or mounting of conductors in these small electrical connectors. The tools illustrated in U.S. Pat. Nos. 3,758,935; 3,816,897; 3,845,535; 3,866,297; 3,965,558 and 3,972,101 are typical examples of the kinds of apparatus developed to meet this need.

While these prior art devices have met with some success, there are several disadvantages associated with their manufacture and use which have limited their acceptance in the industry. Most of the prior art devices are relatively complex apparatus that result in increased manufacturing costs and, in some instances, a higher incidence of field failure. In addition, while the prior art devices have simplified the conductor termination operations to some extent, the steps required in the use of these devices are time consuming and still not entirely satisfactory. For example, many prior art apparatus require separate operations to align the insertion tool with the connector, latch the insertion tool in position and effect the termination. Moreover, while a few of the prior art tools are portable, they are, in most instances, relatively cumbersome, bulky and not truly convenient for use by field technicians.

Finally, so far as applicants are aware, prior art devices do not provide connector locating means which remain in fixed position relative to the insertion blades of the tool. The structure employed in prior art tools to locate the connector are typically mounted to the connector-holding base of the tool, while the insertion tools in these devices are carried on a movable carriage. This arrangement can possibly lead to improper termination if the carriage or other moving parts of the apparatus become worn or misaligned.

SUMMARY OF THE INVENTION

Accordingly, the present invention is directed to an improved terminating apparatus which overcomes the problems associated with the prior art devices. The termination apparatus of the present invention is small, light and truly portable and is designed to greatly facilitate and expedite the in-the-field termination of insulated conductors. Moreover, connector locating means are provided which insure proper alignment of the connector contacts with both the conductors being terminated and the insertion blades effecting the termination.

The terminating apparatus of the present invention includes, generally, a base for supporting the connector in conductor-receiving position, a carriage pivotally mounted to the base and which carries a cam operated insertion tool, connector locating means mounted in fixed position relative to the insertion tool and a self-locking latch mechanism designed to retain the carriage in the operating position. Because of the specific arrangement of the structural components of the tool, most of the termination operations may be expeditiously completed while still assuring a high degree of termination quality, even when the tool is used by unskilled technicians.

In accordance with a preferred embodiment of the present invention, an apparatus is provided for simultaneously terminating a plurality of insulated conductors in the contact members of a multi-contact electrical connector, the apparatus comprising a base, a carriage pivotally attached to the base and carrying an insertion tool thereon, a rotatable cam means for moving the insertion tool into conductor-terminating engagement with the connector, a locating means to properly position the connector and a self-locking latch means for automatically retaining the carriage in the operating position. The latch means includes a release mechanism located in close proximity to the cam means to allow the simultaneous disengagement of the insertion tool from the connector and release of the carriage for movement from the operating position back to the open position. The locating means includes initial locating means on the base providing approximate location of the connector and final locating means mounted on the carriage and providing precise location of the connector.

BRIEF DESCRIPTION OF THE DRAWINGS

The novel features which are believed to be characteristic of the invention are set forth in the appended claims. The invention itself, however, together with further objects and attendant advantages thereof, will best be understood by reference to the following description taken in connection with the accompanying drawings in which:

DETAILED DESCRIPTION OF THE PREFERRED EMBODIMENTS

Figure 1:
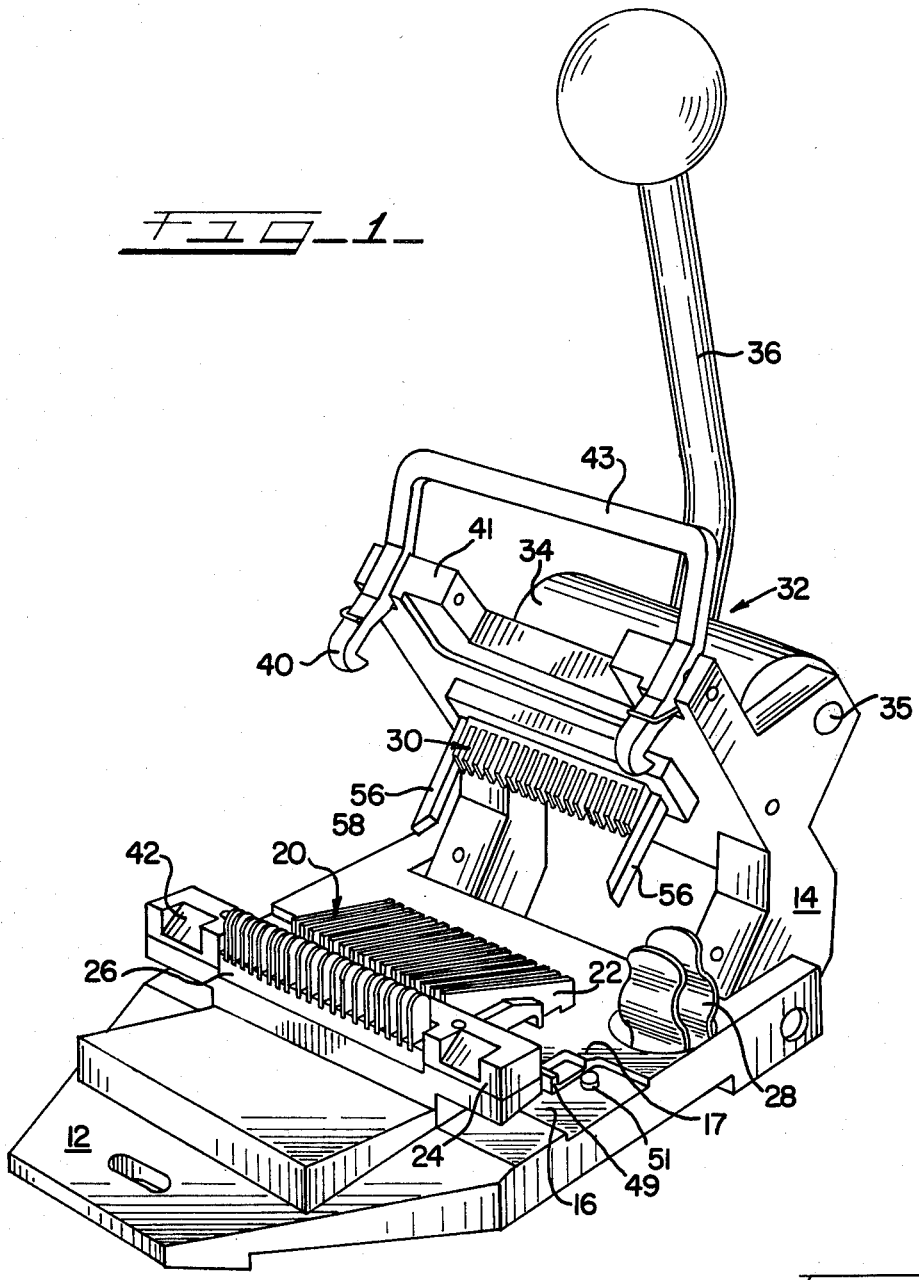
FIG. 1 is a perspective view illustrating a preferred embodiment of the invention with the carriage thereof in at least a partially open position.
Figure 2:
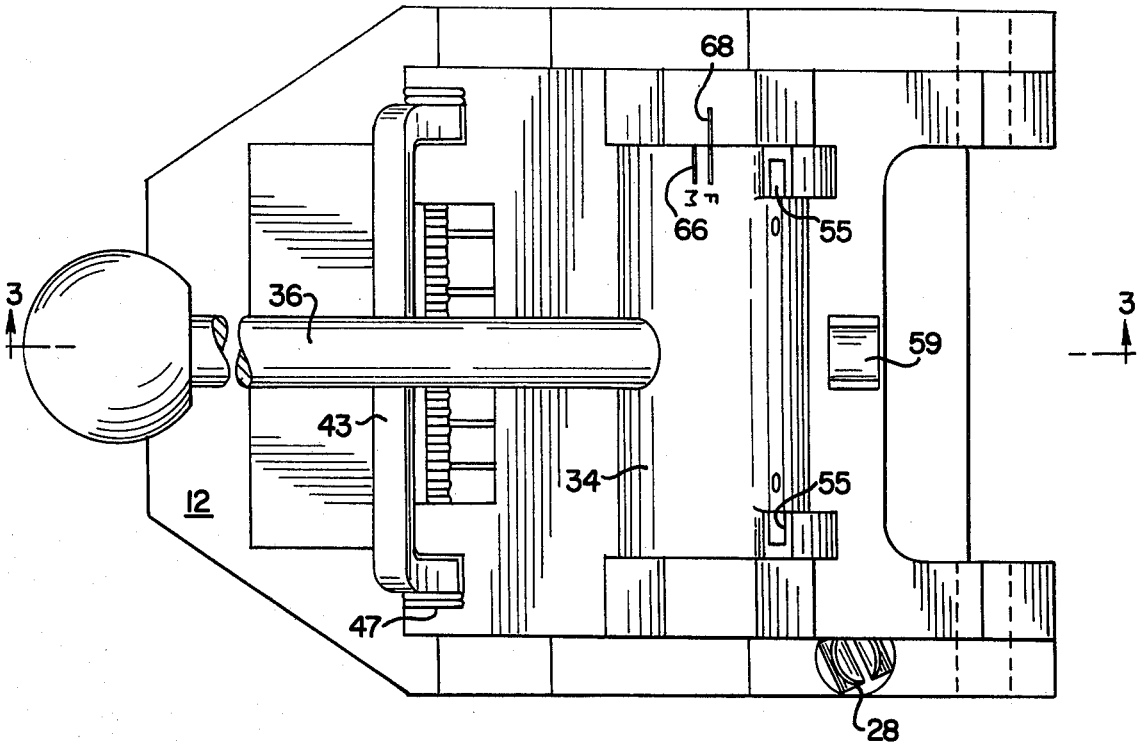
FIG. 2 is a plan view of the embodiment illustrated in FIG. 1.

Referring now to the drawings, and particularly to FIGS. 1 and 2, a conductor terminating apparatus, designated generally as 10, is illustrated, having a base 12 and a carriage 14 pivotally attached to the base. The base 12 includes connector supporting means comprising surfaces 16 and 17. A conductor aligning jig or comb element 20 is also provided through which the individual insulated conductors are dressed and thereby positioned in termination position adjacent the contacts of the connector. The illustrated jig 20 comprises a plurality of individual comb teeth 22 which are removably secured in spaced relation between plates 24 and 26, respectively. Other conductor jig structures may be employed and are well known to those skilled in the art. A spring clamp 28 is disposed on one side of the base 12 to accommodate a bundle of conductors or a multi-conductor cable.

The carriage 14 is pivotally attached to the rear portion of base 12 and is movable between an open position remote from the connector wherein the individual conductors may be conveniently dressed through the jig 20, and a closed, operating position adjacent the connector in which a terminating means is brought into alignment with the connector and conductor jig 20 for the termination operation. The terminating means includes an insertion tool 30 mounted for reciprocal movement in carriage 14 and a rotatable cam means 32, having a cam cylinder 34 eccentrically mounted on shaft 35 and a cam lever 36. As can be clearly seen in FIGS. 3–5, the insertion tool 30 comprises a T-shaped bar having a plate 48, a stem 50 adapted to reciprocal movement within the rectangular collar 52, and a series of spaced insertion blades 54. Cam cylinder 34 includes inwardly facing annular cam recesses 55 which cooperate with the cam following pins 57 at each end of plate 48 to reciprocate the insertion tool 30 as the cam means 32 is rotated by lever 36. A stop 59 is positioned on carriage 14 to prevent excessive rotation of the cam means 32 and the possible withdrawal of stem 50 from collar 52.

Figure 3:
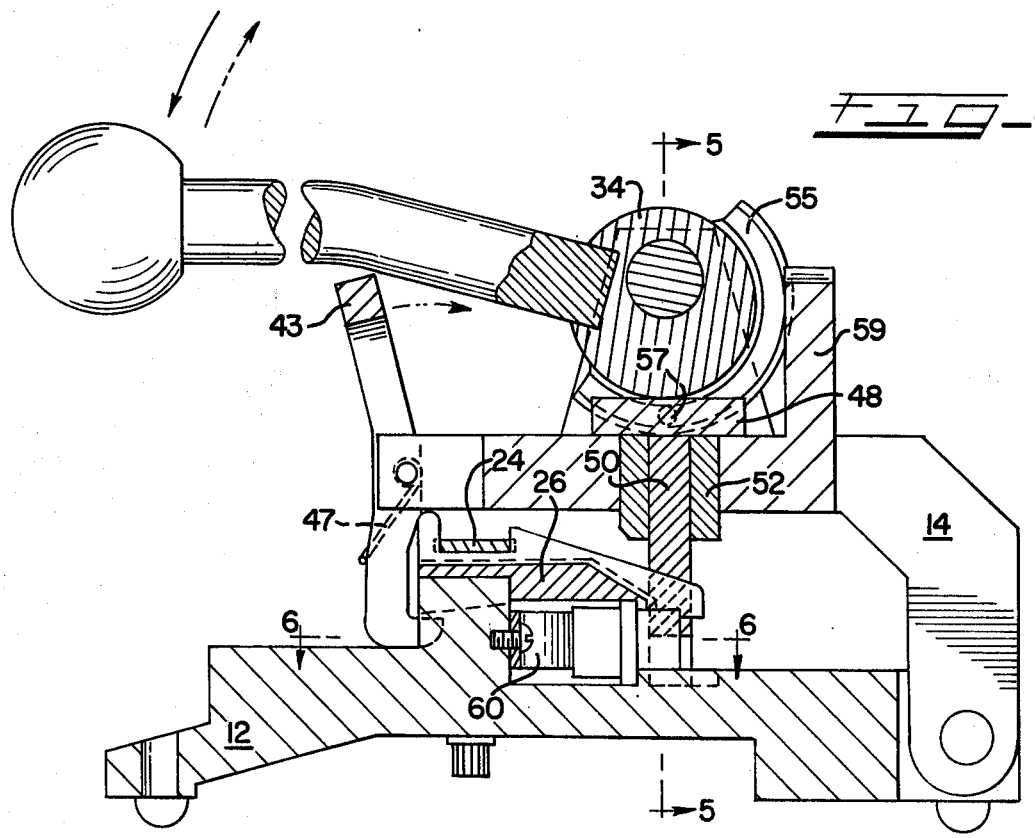
FIG. 3 is a cross-sectional view taken along line 3—3 of FIG. 2 and showing the insertion tool in conductor-terminating engagement with a connector.

In accordance with the present invention, the termination tool 10 is provided with a self-locking latch means which retains the carriage 14 in the operating position. The latch means comprises at least one detent 40 pivotally mounted to the distal end 41 of the carriage 14 and cam and latch surfaces, 42 and 44 respectively. As is clearly illustrated in FIGS. 1 and 2, in accordance with a preferred embodiment of the invention the latch mechanism includes a pair of detents 40 each of which is pivotally mounted to the free end 41 of carriage 14. The detents include release means such as transverse handle 43 which joins the two detents 40. Handle 43 is also positioned in close proximity with the cam lever 36 when the insertion tool 30 is in termination engagement with the connector, as shown in FIG. 3. The detents 40 are biased rearwardly by torsion springs 47 or other suitable biasing means.

It will be appreciated that the illustrated construction and arrangement of the latch mechanism and cam means, while preferred, may be modified in ways apparent to those skilled in the art without loss of the advantages of the present invention. Thus, it is only necessary that the release means for the latch mechanism be sufficiently close to the cam lever 36 when the termination has been completed such that the operator may easily release the latch mechanism and simultaneously rotate the lever 36.

The termination tool 10 also includes improved initial and final locating means to precisely align the connector, both longitudinally and transversely, with respect to the jig 20 and the insertion tool 30.

Figure 6:
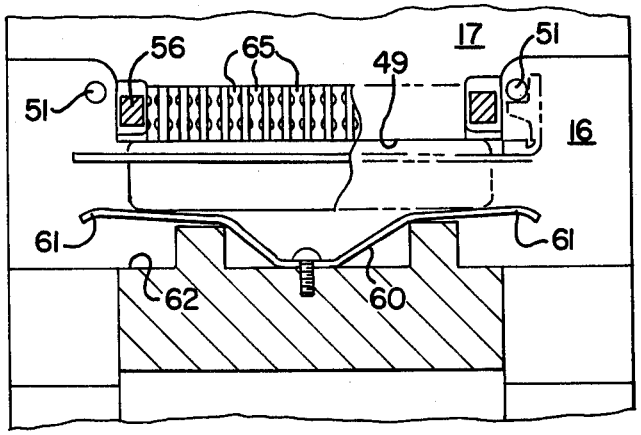
FIG. 6 is a partial view, in cross-section, taken along line 6—6 of FIG. 3 and illustrating more clearly the connector supporting and locating structure of the present invention.

The initial or preliminary locating means is provided on base 12 and comprises a connector locating shoulder 49 and studs 51 which abut external surfaces on the connector to locate the connector longitudinally. As can be best seen in FIG. 6, a leaf spring 60 is mounted on wall 62 opposite the connector locating shoulder 49. Leaf spring 60 includes outwardly flaring extremities 61 which bias the connector against shoulder 49, thereby properly locating the connector transversely with respect to both the conductor jig 20 and insertion tool 30 and properly orientating the contact members 65 for acceptance of the insulated conductors. Thus, shoulder 49 provides an initial alignment of the connector to facilitate the precise, final alignment effected by the final locating means.

The final locating means is mounted on the carriage 14 and comprises a pair of pins 56 which depend from collar 52 and terminate at extremities which are below the lowermost travel of the insertion blades 54. The extremities of pins 56 are formed as camming surfaces 58. As the carriage 14 is rotated to the operating position, the surfaces 58 engage the opposite ends of the connector to insure its proper longitudinal alignment with the insertion tool 30. Since the pins 56 are mounted to the carriage 14, they are disengaged from the connector as the carriage is retracted from the operating position, and the operator is not required to disengage them in a separate operation.

Suitable conductor retaining means are also provided in order to hold the individual conductors within the slots defined by comb teeth 22 after the conductors have been dressed through the jig 20. One such retaining means comprises a series of dimples (not shown) formed in the comb teeth 22, each dimple acting with an adjacent comb tooth to restrain movement of the conductors. Another known retaining means comprises a closed-helix coil spring mounted to the jig 20. Of course, other suitable retaining means will be readily apparent to those skilled in the art.

In order to insure that the proper termination force is applied when terminating conductors in either male or female connectors, the cam cylinder 34 includes termination indicia comprising score lines 66 which align with a score line 68 on the carriage 14 when the appropriate degree of rotation of cylinder 34 has been effected.

In the operation of the present invention a multi-contact electrical connector having a two oppositely facing rows of insulation-piercing contact members is inserted into the cavity defined by the conductor jig 20 and surface 16. The outwardly flaring extremities 61 of leaf spring 60 force the connector into abutment with shoulder 49 with the portion of the connector carrying the insulation-piercing contact members resting on support surface 17. With the carriage 14 in the open position, a cable comprising a bundle of individual insulated conductors is secured in the clamp 28, and the conductors are dressed through the slots defined by the comb teeth 22.

Figure 4:
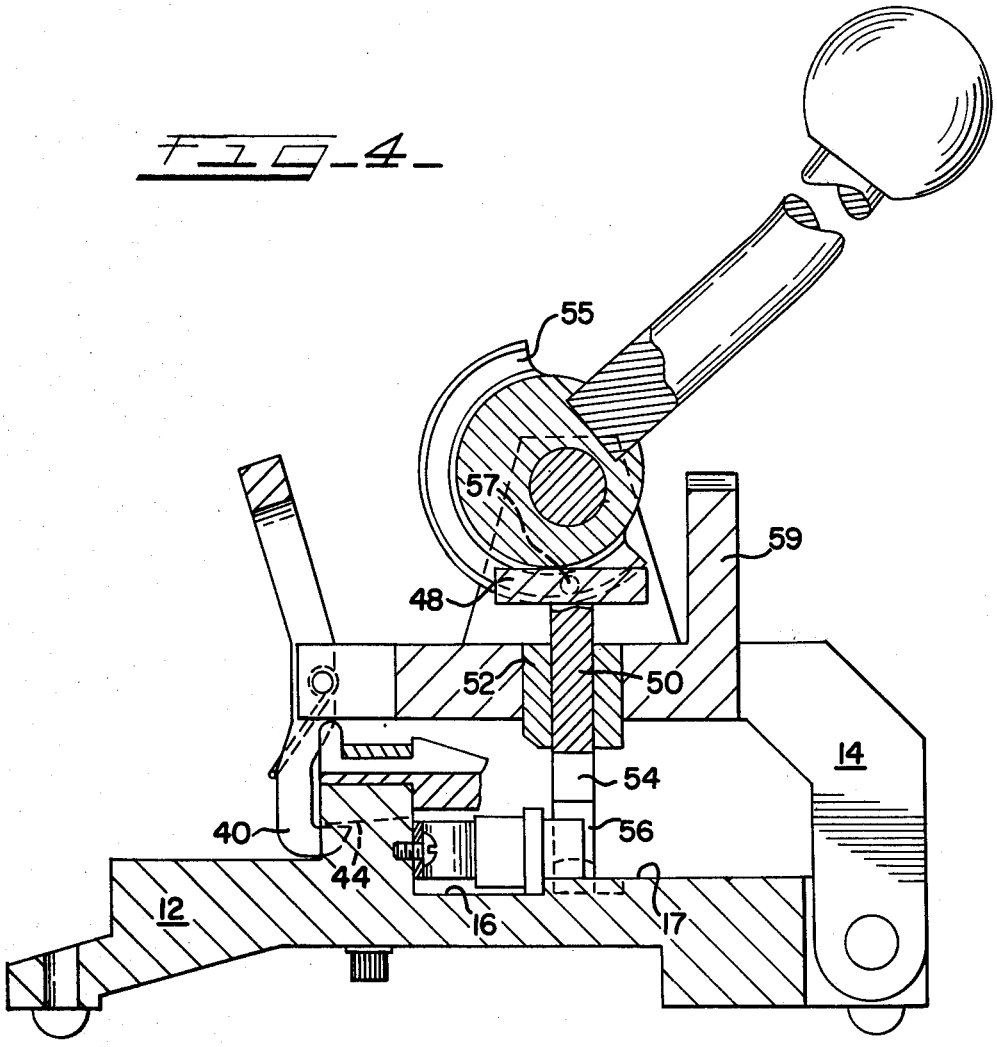
FIG. 4 is a view similar to that of FIG. 3, in partial cross-section, showing the insertion tool disengaged from the connector.
Figure 5:
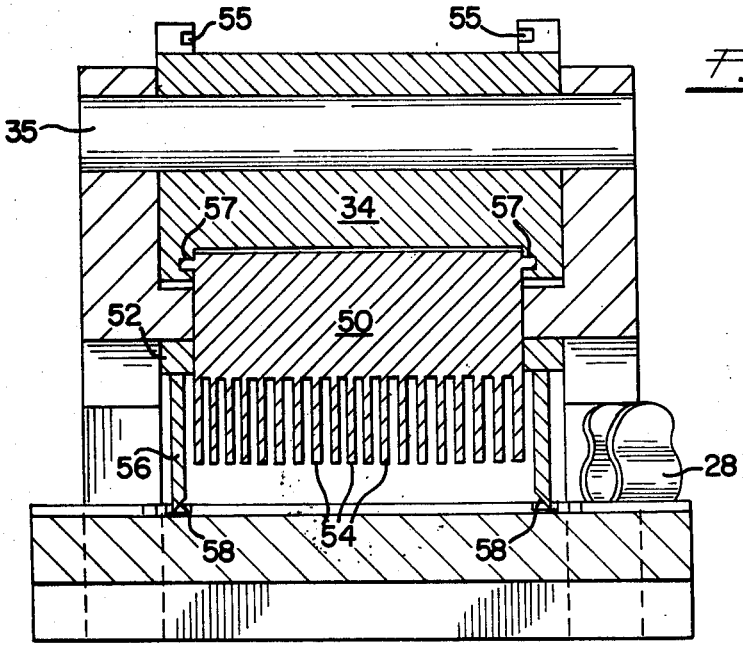
FIG. 5 is a cross-sectional view taken along line 5—5 of FIG. 3 with the connector removed and illustrating, in greater detail, the insertion tool and a preferred connector locating means.

After having dressed the conductors for the desired wiring schedule, the operator grasps handle 36 and the carriage 14 is pivoted to the operating position, shown for example in FIG. 4, with the detents 40 of the latch means riding over cam surfaces 42 and into locking engagement with surface 44 of the base. At the same time, the locating pins 56 mounted in collar 52 drop over the ends of the connector, thereby properly locating the connector longitudinally with the insertion tool 30. In this manner, the carriage 14 is brought to a locked operating position with the insertion tool 30 properly aligned adjacent the conductor jig 20 and the connector.

As the carriage 14 reaches the locked operating position, the operator continues the rotation of cam lever 36 in a single, continuous motion, as depicted by the solid arrow in FIG. 3. This operation actuates cam cylinder 34 and drives the insertion blades 54 of insertion tool 30 down into engagement with the insulated conductors and into the respective contact members 65 of the connector. Thus, in the manner well known in the art, the individual conductors are trimmed and terminated in the respective insulation-piercing contacts. The required rotation of cam cylinder 34 is indicated by the termination indicia, as is shown in FIG. 2. The operator then reverses the rotation of cam lever 36 and at the same time depresses release handle 43 in a rearward direction as depicted by the dashed-line arrows in FIG. 3, thereby unlocking and pivoting the carriage 14 to the open position, again all in a single motion. The stop 59 assures that lever 36 is not rotated to such an extent that the pins 57 disengage from cam recesses 55. The cable is then removed from the clamp 28 and the connector may be disengaged from the conductor jig 20.

In order to terminate the remaining conductors in the oppositely facing row of contact members, the connector is inverted and reinserted into the cavity below the conductor jig 20, and the operations described above are repeated.

It will be appreciated from the foregoing description that the present invention provides not only a small and truly portable termination tool, but also one which is reliable and very easy to use. In addition to the improved locating means and the self-locking latch mechanism, the present invention also provides a carriage which pivots easily out of the way for expedited wiring and still employs a reciprocating insertion tool whose path of travel, relative to the connector, is linear rather than arcuate.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. Apparatus for simultaneously terminating a plurality of insulated conductors in the contact members of an electrical connector, comprising:

a base including means for supporting the connector in conductor-receiving position;

a carriage pivotally attached to said base and movable between an open position wherein said carriage is remote from said connector and an operating position wherein said carriage is adjacent said connector;

an insertion tool mounted for reciprocal movement in said carriage and including means for engaging and pressing said conductors into respective contact members of the connector when said carriage is in said operating position to thereby terminate said conductors in said respective contact members;

rotatable cam means mounted on said carriage for moving said insertion tool into and out of conductor-terminating engagement with said connector, said cam means including cam actuating means for rotating said cam means; and self-locking latch means on said carriage adjacent its distal end for retaining said carriage in said operating position and including release means located adjacent said cam actuating means when said insertion tool is in conductor-terminating engagement with said connector.

2. The termination apparatus of claim 1 wherein said latch means comprises a spring bias detent pivotally mounted to said carriage and wherein said base includes a cam surface and a latch surface, said detent being provided for engaging said cam surface as said carriage approaches the operating position to guide said detent into locking position with said latch surface.

3. The termination apparatus of claim 2 wherein said latch means comprises a pair of said detents coacting with respective pairs of cam and latch surfaces, and wherein said release means comprises a transverse member joining said pair of detents.

4. The termination apparatus of claim 1 wherein said cam means comprises a cam cylinder eccentrically mounted to said carriage and said cam actuating means comprises an elongated lever.

5. The termination apparatus of claim 4 wherein said cam cylinder includes at least one circumferential collar having an annular recess which cooperates with a pin member of said insertion tool to effect said reciprocal movement of said insertion member as said cam means is rotated.

6. The termination apparatus of claim 1 further including means for indicating that said insertion tool is in conductor-terminating engagement with said connector.

7. The termination apparatus of claim 6 wherein said indicating means comprises score lines on said cam means and said carriage positioned to align when said insertion tool is in said conductor-terminating position.

8. The termination apparatus of claim 1 further including means for aligning each said conductor in terminating position adjacent one of the connector contact members.

9. The termination apparatus of claim 8 wherein said conductor aligning means includes means for retaining said conductors in said terminating position.

10. The terminating apparatus of claim 1 further including connector locating means for aligning the connector longitudinally with respect to the insertion tool, said locating means mounted on and movable with said carriage in fixed position relative to said insertion tool.

11. The termination apparatus of claim 10 wherein said locating means comprises a pair of pins depending from said carriage.

12. The termination apparatus of claim 11 wherein said pins each include a cam surface extremity.

13. The termination apparatus of claim 11 wherein said pins each terminate at a level below the lowermost point of travel of said termination tool.

14. An apparatus for simultaneously terminating a plurality of insulated conductors in a multi-contact electrical connector, said connector having at least one row of insulation-piercing contact members arranged therein, said apparatus comprising:

base including means for supporting the connector in conductor-receiving position;

a carriage pivotally attached to the base and movable between an open position remote from the connector and an operating position adjacent the connector;

means mounted on said carriage for terminating the conductors in respective contact members of the connector and including hand-operated means to actuate said terminating means; and self-locking latch means for retaining said carriage in said operating position and including hand-operated release means to disengage said latch means, said release means and said actuating means being arranged such that, when said terminating means is in conductor-terminating engagement with said connector, said latch means may be disengaged and said carriage may be moved to the open position by a one-handed operation.

* * * * *